US010463122B2

(12) United States Patent
Halton et al.

(10) Patent No.: US 10,463,122 B2
(45) Date of Patent: Nov. 5, 2019

(54) UMBRELLA

(71) Applicant: BRAND DEVELOPERS LTD, Auckland (NZ)

(72) Inventors: Philippa Halton, Auckland (NZ); Brendon Tait, Auckland (NZ)

(73) Assignee: BRAND DEVELOPERS LTD (NZ)

( * ) Notice: Subject to any disclaimer, the term of this patent is extended or adjusted under 35 U.S.C. 154(b) by 0 days.

(21) Appl. No.: 15/512,543

(22) PCT Filed: Sep. 18, 2015

(86) PCT No.: PCT/AU2015/000576
§ 371 (c)(1),
(2) Date: Mar. 17, 2017

(87) PCT Pub. No.: WO2016/040994
PCT Pub. Date: Mar. 24, 2016

(65) Prior Publication Data

US 2017/0303649 A1 Oct. 26, 2017

(30) Foreign Application Priority Data

Sep. 19, 2014 (AU) ..... 2014903753

(51) Int. Cl.
*A45B 25/22* (2006.01)
*A45B 25/02* (2006.01)
(Continued)

(52) U.S. Cl.
CPC ..... *A45B 25/22* (2013.01); *A45B 25/02* (2013.01); *A45B 25/06* (2013.01); *A45B 25/08* (2013.01); *A45B 25/16* (2013.01)

(58) Field of Classification Search
CPC ..... A45B 25/00; A45B 25/02; A45B 25/06; A45B 25/08; A45B 25/22; A45B 2019/001; A45B 25/16
(Continued)

(56) References Cited

U.S. PATENT DOCUMENTS 163,821 A * 5/1875 Steinmetz ..... A45B 19/06 135/26
205,613 A * 7/1878 Charageat ..... A45B 25/22 135/27
(Continued)

FOREIGN PATENT DOCUMENTS

CN 201328444 Y 10/2009
CN 103653610 A 3/2014
JP 2017035247 A * 2/2017 ..... A45B 11/00

OTHER PUBLICATIONS

International Search Report issued in PCT/AU20158/000576 dated Dec. 9, 2015 (6 pages).
(Continued)

*Primary Examiner* — Winnie Yip

(57) ABSTRACT

Disclosed is an umbrella that can be used as a canopy to protect a user against rain or sunlight. The umbrella may comprise an elongate member having proximal and distal end portions, a support structure that is connectable to a canopy able to be disposed about the distal end portion of the elongate member, the support structure being be adjustable between an erect position, whereby the canopy is able to be tensioned by the support structure, and a collapsed position, whereby the tension in the canopy is able to be released. The umbrella may also include a plurality of biasing means configured to inhibit the support structure from inverting.

11 Claims, 20 Drawing Sheets

(51) Int. Cl.
*A45B 25/06* (2006.01)
*A45B 25/08* (2006.01)
*A45B 25/16* (2006.01)

(58) Field of Classification Search
USPC ..... 135/23, 25.33, 27–32, 37–41
See application file for complete search history.

(56) References Cited

U.S. PATENT DOCUMENTS 929,117 A * 7/1909 Black et al. ..... A45B 19/06 135/26
RE21,492 E * 6/1940 Okun ..... A45B 19/10 135/25.31
3,565,087 A * 2/1971 Choji Arai ..... A45B 25/16 135/23
4,407,317 A 10/1983 Crandall
6,006,770 A * 12/1999 Lin ..... A45B 25/02 135/29
6,053,188 A * 4/2000 Walker ..... A45B 25/02 135/26
6,167,894 B1 * 1/2001 Lin ..... A45B 25/02 135/15.1
6,276,380 B1 * 8/2001 Okuda ..... A45B 25/22 135/31
7,913,709 B2 * 3/2011 Brebner ..... A45B 19/06 135/31
2003/0178050 A1 * 9/2003 Wu ..... A45B 25/22 135/32
2003/0205267 A1 11/2003 Lin et al.

OTHER PUBLICATIONS

Written Opinion issued in PCT/AU20158/000576 dated Dec. 9, 2015 (9 pages).
International Preliminary Report on Patentability issued in PCT/AU20158/000576 dated Feb. 9, 2017 (54 pages).
An English translation of a first official action and search report dated Sep. 26, 2018 issued on corresponding Chinese patent application No. 201510601739.2.

* cited by examiner

UMBRELLA

RELATED APPLICATIONS

This application is filed under 35 U.S.C. § 371 as the U.S. national phase of International Patent Application No. PCT/AU2015/000576, filed Sep. 18, 2015, which designated the U.S. and claims priority to Australian Patent Application No. 2014903753, filed Sep. 19, 2014. The entire disclosure of both applications, including any drawings, is hereby incorporated herein by reference.

TECHNICAL FIELD

This disclosure relates to umbrellas that can be used as a canopy to protect a user against rain or sunlight.

BACKGROUND OF THE INVENTION

Umbrellas, or parasols, can be used as a canopy to protect a user from the sun, wind or rain. Umbrellas may be portable structures or may be fixed to the ground. Umbrellas may include a shaft that has a handle at one end and a canopy at the other end. A collapsible canopy support structure may be included to support the canopy and, when not in use, allows for the canopy to collapsed. The collapsible canopy support structure may also include multiple arms that radiate from the shaft to tension the canopy when erected. A problem with umbrellas is that they catch the wind and the force exerted by the wind on the underside of the canopy can turn the umbrella inside out (e.g. invert the collapsible canopy structure).

The above references to the background art do not constitute an admission that the art forms part of the common general knowledge of a person of ordinary skill in the art. The above references are also not intended to limit the application of the umbrella as disclosed herein.

SUMMARY

Disclosed herein is an umbrella. The umbrella may comprise an elongate member having proximal and distal end portions. The umbrella may also comprise a support structure that is connectable to a canopy able to be disposed about the distal end portion of the elongate member. The support structure may be adjustable between an erect position, whereby the canopy is able to be tensioned by the support structure, and a collapsed position, whereby the tension in the canopy is able to be released. The umbrella may also include a collar having an interior channel formed therethrough, the channel being configured to receive therethrough the elongate member. The umbrella may further include a plurality of biasing means mounted to both the support structure and the collar. Each biasing means may be configured to bias the support structure towards, so as to maintain the support structure in, the erect position when a force is applied to an underside of the canopy to inhibit the support structure from inverting.

In some forms, each biasing means may be pivotally mounted to the support structure. This allows for the biasing means to move with the support structure when the umbrella is adjusted between its erect and collapsed positions.

In some forms, each biasing means may be resilient and curved along its length in its neutral position such that the biasing means is able to bend when the force is applied to the underside of the canopy and the resilience of the biasing means biases it towards its neutral position. Advantageously, the biasing means may oppose a force applied to the arms by a force (e.g. wind) that is applied to the underside of the canopy.

In some forms, when the umbrella is in an inverted position, each biasing means may be able to move towards its neutral position (i.e. by tending to straighten) upon release of the applied force such that the support structure is biased towards the erect position. This enables the umbrella to be self-righting.

In some forms, the support structure may comprise a slider connected to the elongate member. The slider may be able to move along the elongate member between locations intermediate the proximal and distal end portions of the elongate member. The support structure may also comprise a plurality of arms, each arm being disposed about and pivotally connected to the distal end portion of the elongate member. The support structure may further comprise a plurality of rods, each rod being disposed about and pivotally connected to both the slider and a respective arm. In use, movement of the slider along the elongate member towards the distal end portion of the elongate member can cause each rod to pivot the arm to which it is connected away from the elongate member such that the slider is able to adjust the support structure into the erect position. Further, movement of the slider along the elongate member towards the proximal end portion of the elongate member can cause each rod to pivot the arm to which it is connected towards the elongate member such that the slider is able to adjust the support structure into the collapsed position.

In some forms, each arm may comprise first and second ends. The first end may be spaced from the elongate member when the support structure is in the erect position. The second end may be pivotally connected to the distal end portion of the elongate member.

In some forms, each arm may comprise a first connector. The first connector may be mounted intermediate the first and second ends of the arm such that the first connector is fixed in position along the arm. Each arm may also comprise a second connector. The second connector may be mounted intermediate the first connector and the second end of the arm such that the second connector can be fixed in position along the arm.

In some forms, each rod may be pivotally connected to a respective first connector.

In some forms, each biasing means may be pivotally connected to a respective second connector.

In some forms, the second connectors may be fixed to the arms.

In some forms, the first connectors may each comprise an integral projecting finger. Each projecting finger may include an aperture adapted to receive a pin about which each rod may rotate.

In some forms, the second connectors may each comprise a single integral projecting finger. Each projecting finger may include an aperture adapted to receive a pin about which each biasing means may rotate.

In some forms, the biasing means may be bifurcated at its end to locate on either side of the projecting finger of the second connector.

In some forms, the support structure may further comprise a plurality of canopy tensioners. Each canopy tensioner may be connected to the first end of a respective arm.

In some forms, each canopy tensioner may comprise a body having an internal cavity that is adapted to receive the arm to which it is connected. Each canopy tensioner may also comprise shoulders that are integrally formed with and extend away from the body. The shoulders may be configured to be received by and tension the canopy when the support structure is in the erect position.

In some forms, each canopy tensioner may comprise an alignment member having an internal cavity that is adapted to receive the arm to which it is connected; and shoulders that are integrally formed with and extend away from the alignment member, the shoulders configured to be received by and tension the canopy when the support structure is in the erect position. In some forms, the shoulders may be connected (i.e. not integrally formed with) the alignment member.

In some forms, each canopy tensioner may further comprise a resilient member that, in use, can be disposed about the first end of a respective arm. The resilient member may be constrained from movement along the arm by the body and a locator that is mounted to the arm. The locator may be spaced from the first end of the arm. This allows for the tension in the canopy and support structure to be limited in the event that the canopy inverts.

In some forms, each canopy tensioner may further comprise opposing resilient members that, in use, are disposed adjacent a respective arm, the resilient members being connected at either end and constrained from movement along the arm by the alignment member and a locator that is mounted to the arm, the locator being spaced from the first end of the arm.

In some forms, the resilient member may be a coil spring through which a portion of the arm extends.

In some forms, the resilient members are leaf springs that are integrally formed with the alignment member and the locator. In some forms, an outer portion of the leaf springs may form the shoulders of the canopy tensioner.

In some forms, an end of the spring may engage the locator and its opposite end may engage a wall of the body. In some forms, the alignment member may be configured to telescopically translate along a respective arm when the support structure is adjusted between the collapsed and erect positions.

In some forms, the umbrella may further comprise a collar having an interior channel formed therethrough. The channel may be configured to receive therethrough the elongate member, a plurality of projections may be integrally formed with the collar. The projections may extend radially about the collar. The umbrella may also comprise a plurality of recesses. Each recess may be defined between adjacent projections. Each recess may be configured to receive therein an end of a respective biasing means such that the biasing means may be pivotally mounted to the collar.

In some forms, the collar may be slidably mounted to the elongate member and, in use, may be located intermediate (e.g. between) the slider and the pivotal connection between the arms and the elongate member.

In some forms, each projection may comprise a groove formed therethrough. The grooves may be adapted to receive a retainer that is disposed about the collar.

In some forms, each biasing means may comprise an aperture that is able to receive the retainer such that the biasing means can be pivotally mounted to the collar.

In some forms, the retainer may be a length of wire that is threaded through the projection grooves and the apertures of the biasing means.

In some forms, the umbrella may further comprise a locking means that is configured to lock the slider to the elongate member when the support structure is erected.

In some forms, the biasing means may be a leaf spring.

In some forms, the biasing means may be a sprung member.

In some forms, the elongate member may further comprise a handle located at the proximal end.

Also disclosed herein is an umbrella that may comprise an elongate member having proximal and distal end portions. A support structure that is connectable to a canopy may be disposed about the distal end portion of the elongate member. The support structure may be adjustable between an erect position, whereby the canopy is able to be tensioned by the support structure, and a collapsed position, whereby the tension in the canopy is able to be released. The umbrella may also comprise a plurality of canopy tensioners connected to the support structure. Each canopy tensioner may comprise an alignment member having an internal cavity that is adapted to receive a respective arm of the support structure and shoulders that are integrally formed with and extend away from the alignment member. In other forms, the shoulders may be connected to (i.e. not integrally formed with) the alignment member. The shoulders may be configured to be received by and thereby tension the canopy when the support structure is in the erect position.

In some forms, each canopy tensioner may further comprise opposing resilient members that, in use, are disposed about a respective arm, live resilient member being connected at either end and constrained from movement along the and by the alignment member and a locator that is mounted to the arm, the locator being spaced from an end of the arm.

In some forms, the canopy tensioner may be configured to reduce the hoop stress in the canopy when the support structure is adjusted between the erect position and an inverted position. In some forms, each alignment member may be configured to displace laterally with respect to its respective elongate member upon adjustment of the support structure between the erect position and the inverted position to thereby decrease a combined length of each canopy tensioner and its respective elongate member to thereby reduce the hoop stress in the canopy.

Also disclosed herein is an umbrella that comprises an elongate member having proximal and distal end portions. A support structure that is connectable to a canopy may be disposed about the distal end portion of the elongate member. The support structure may be adjustable between an erect position, whereby the canopy is able to be tensioned by the support structure, and a collapsed position. The tension in the canopy may be able to be released. The umbrella may also comprise a plurality of biasing means mounted to both the support structure and the distal end portion of the elongate member. Each biasing means may be configured to bias the support structure towards, so as to return the support structure to, the erect position when the umbrella is inverted. Advantageously, this allows for the umbrella to be self-righting, in that the umbrella can return itself to the erect position in the event that that canopy and support structure are inverted (e.g. the umbrella is folded inside out).

BRIEF DESCRIPTION OF THE DRAWINGS

Embodiments will now be described by way of example only, with reference to the accompanying drawings in which

FIGS. 13*a-c* show cross-sections through the alternate locking means of FIG. 12 in the unlocked (a and b) and locked (c) positions;

DETAILED DESCRIPTION

Figure 1:
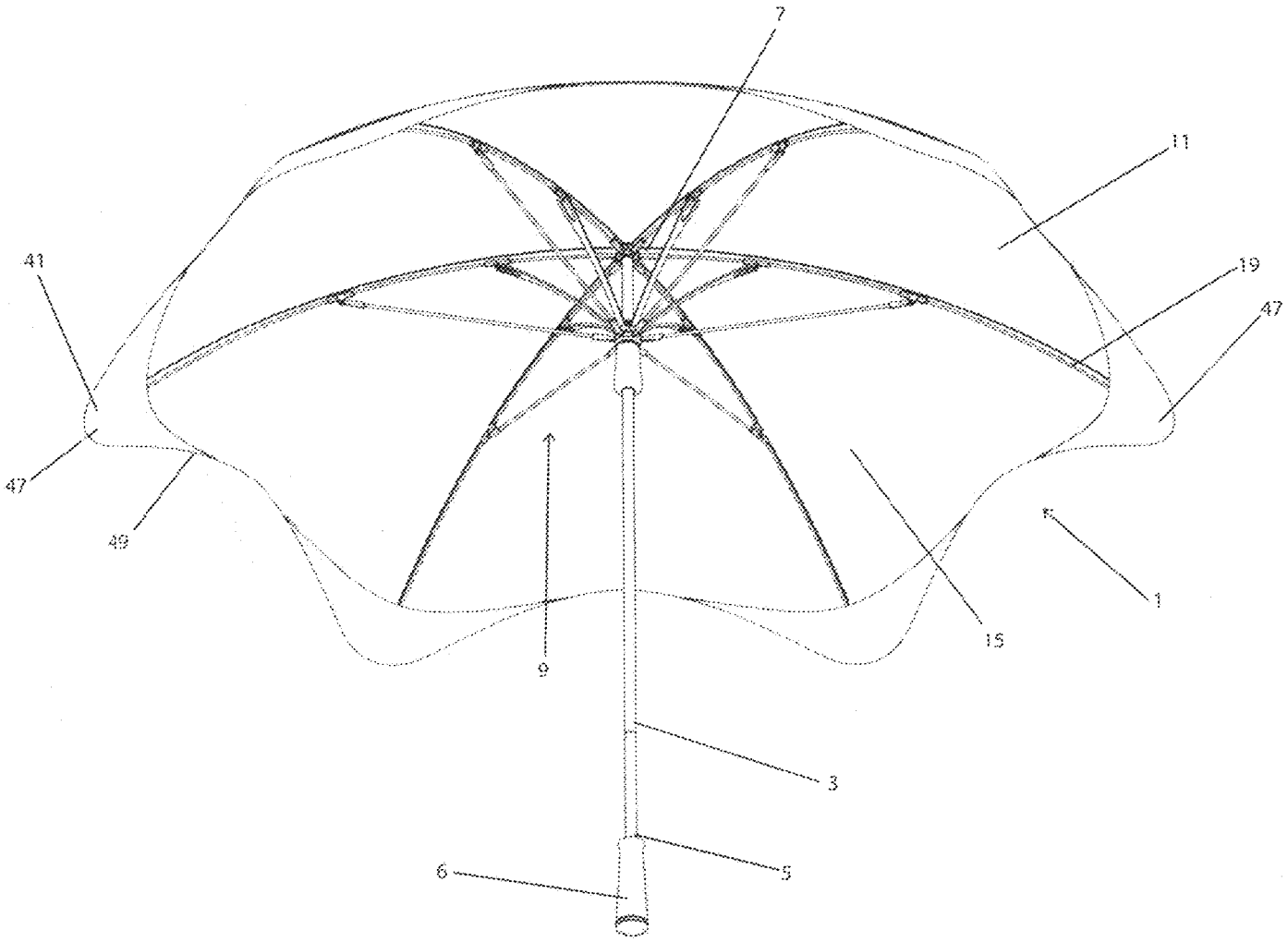
FIG. 1 shows a perspective view of the umbrella.

In the following detailed description, reference is made to accompanying drawings which form a part of the detailed description. The illustrative embodiments described in the detailed description, depicted in the drawings and defined in the claims, are not intended to be limiting. Other embodiments may be utilised and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

Figure 2:
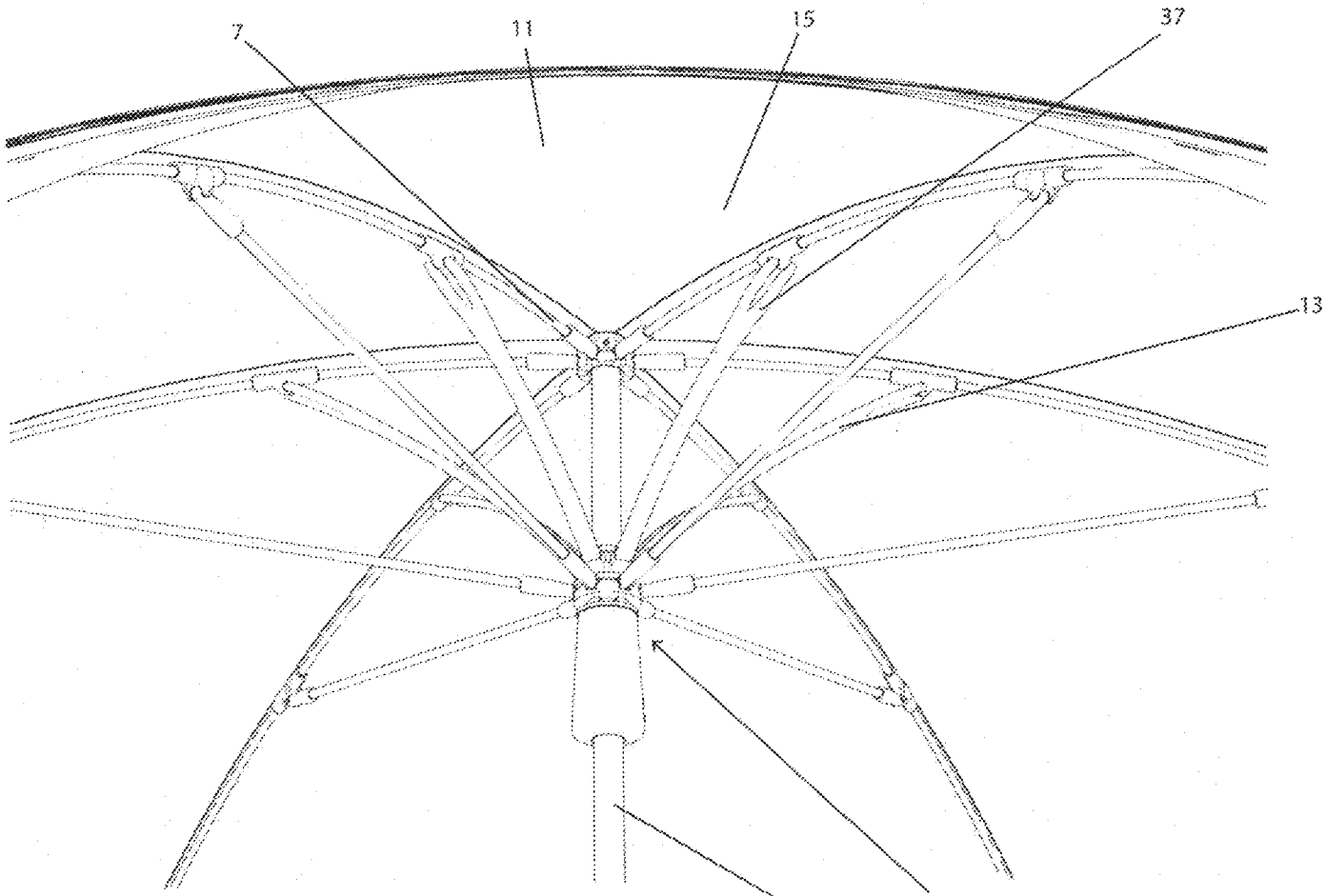
FIG. 2 shows a perspective view of the support structure of the umbrella.
Figure 3:
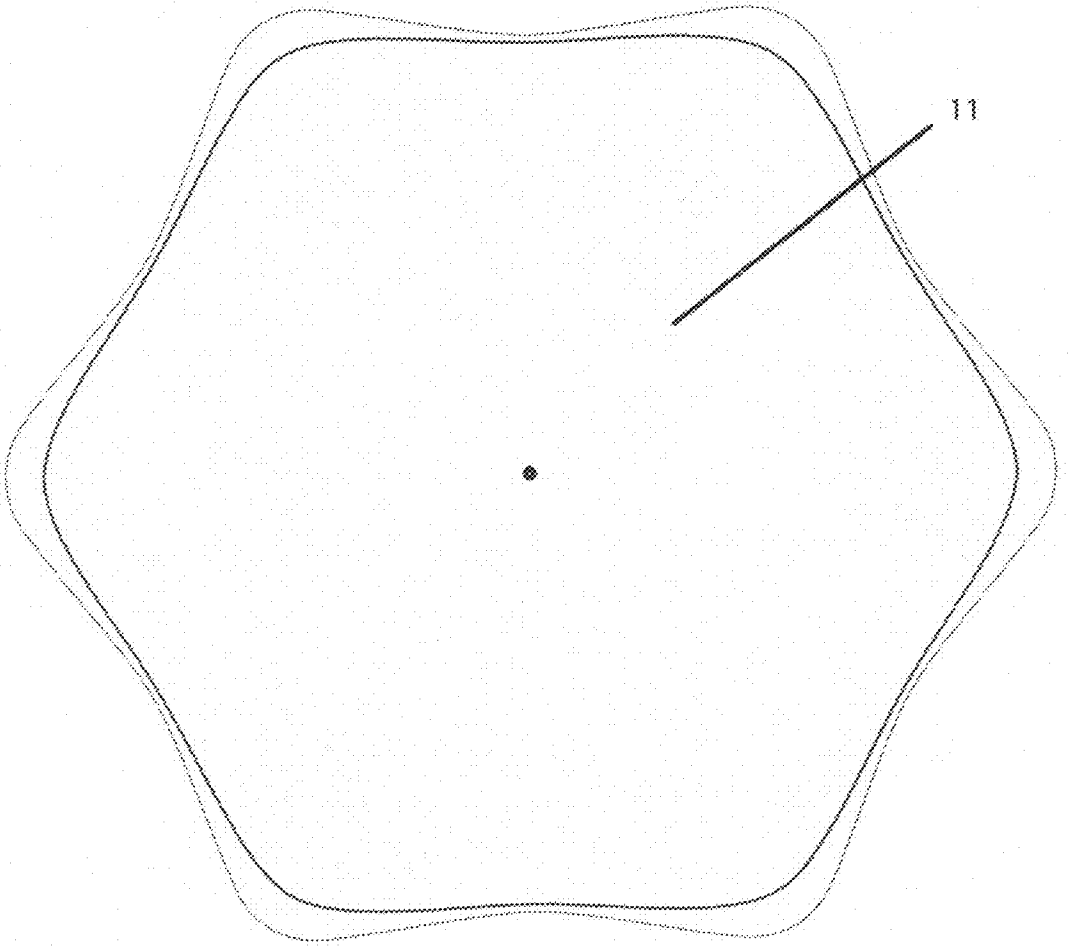
FIG. 3 shows a top view of the umbrella.

Referring firstly to FIG. 1, an umbrella 1 according to the present disclosure is described. The umbrella 1 includes an elongate member, in the form of shaft 3, having proximal 5 and distal end 7 portions. The shaft 3 includes a handle 6 at its proximal end 5 that allows a user to hold the umbrella 1. Referring now to FIG. 2, the umbrella will be described in further detail. The umbrella 1 includes a support structure 9 that is connected to a canopy 11, in the form of a fabric sheet or sheets (e.g. a plurality of canvas sheets sewn together), disposed about the distal end portion 7 of the shaft 3. The support structure 9 is adjustable between an erect position, as shown in FIG. 1, and a collapsed position. In the erect position, the canopy 11 is able to be tensioned by the support structure 9 to form a semi rigid structure under which a user is protected from rain or sun. In the collapsed position, the tension in the canopy 11 is able to be released such that the canopy becomes loose. When not in use, the umbrella 1 can be stored in the collapsed position.

Figure 11A:
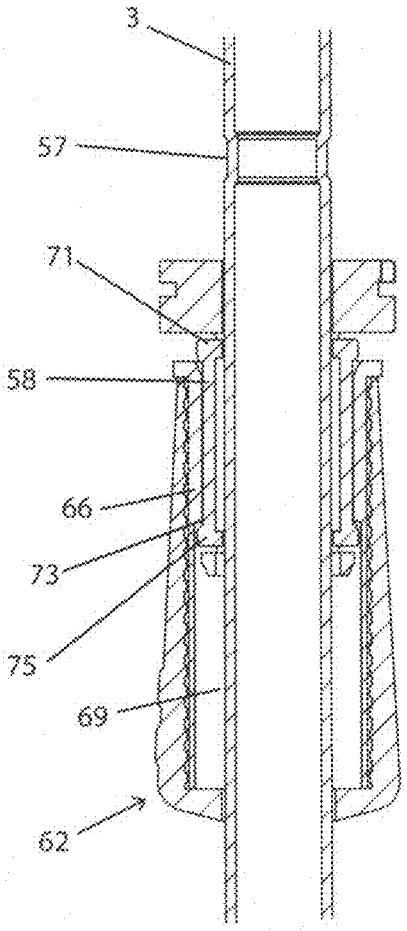
FIG. 11*a-b* show cross-sections through the locking means in the unlocked (a) and locked (b) conditions.
Figure 11B:
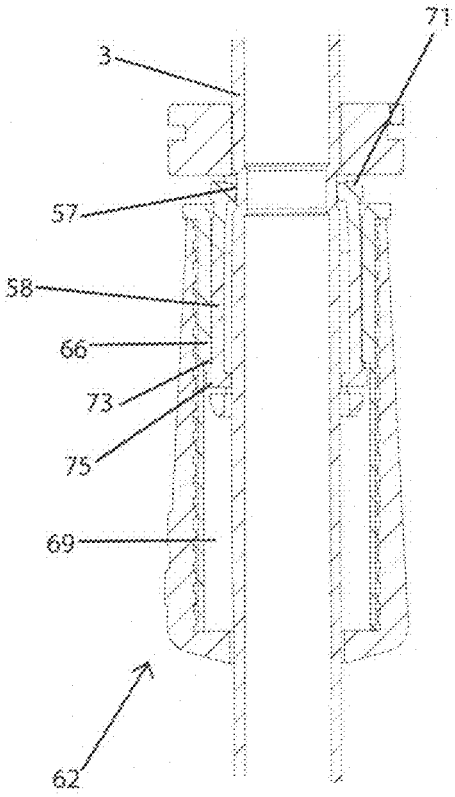
Figure 12A:
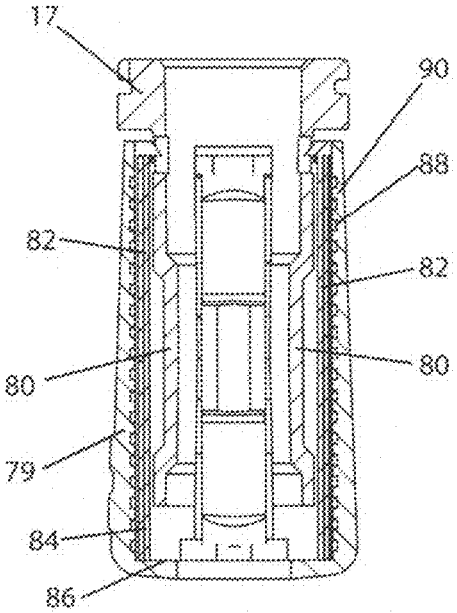
FIGS. 12*a-b* show cross-sections through an alternate locking means.
Figure 12B:
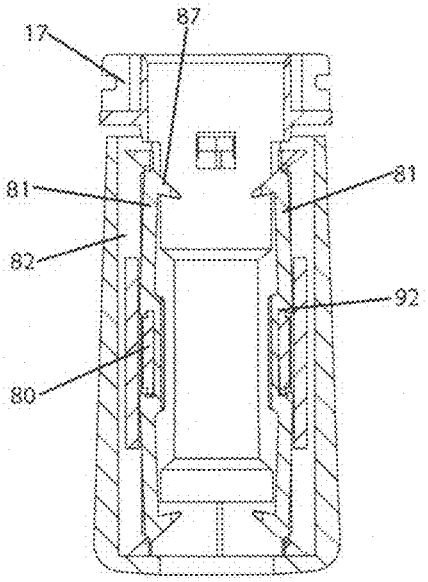

The umbrella 1 includes a plurality of biasing means, in the form of leaf springs 13, mounted to both the support structure 9 and the distal end portion 7 of the shaft 3. Each leaf spring 13 is configured to bias the support structure 9 towards, so as to maintain the support structure 9 in, the erect position when a force (e.g. wind) is applied to an underside 15 of the canopy 11 to inhibit the support structure 9 from inverting (e.g. turning inside out). Each leaf spring 13 is pivotally mounted to the support structure 9. The leaf springs 13 are also able to bias the support structure 9 and canopy 11 towards the erect position in the event that the support structure and canopy are inverted (FIGS. 11 and 12). This allows for the umbrella to be self-righting.

Figure 4:
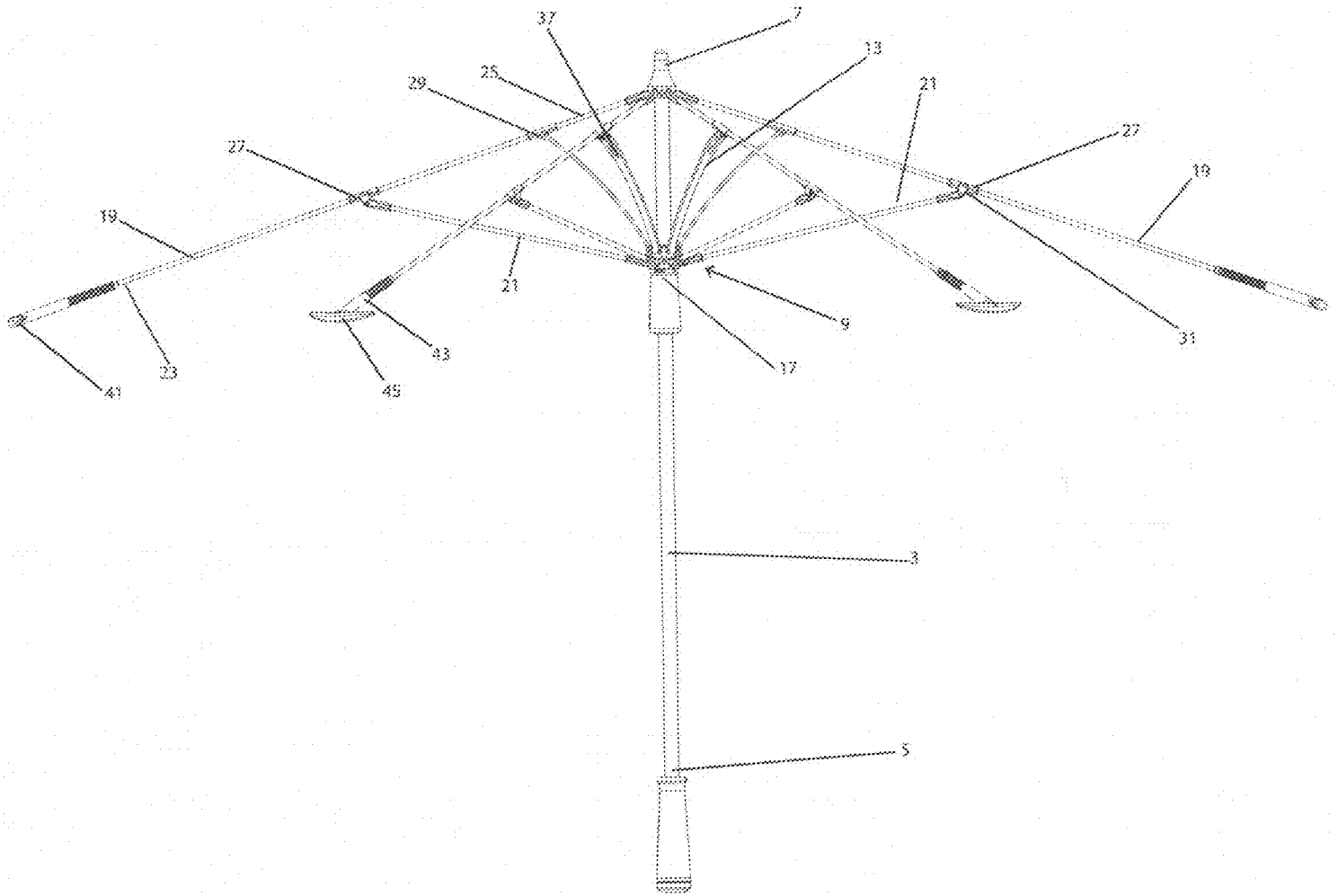
FIG. 4 shows a side view of the umbrella.
Figure 5:
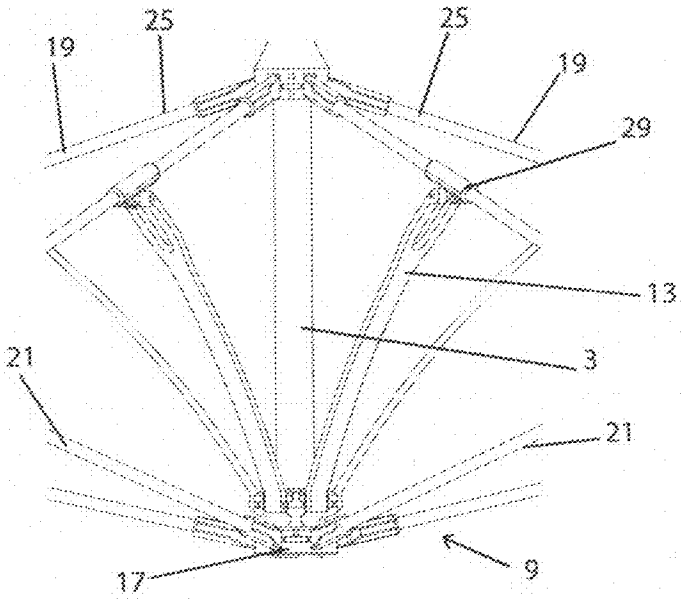
FIG. 5 shows a side view of the support structure of the umbrella.

Referring now to FIGS. 4 and 5, the support structure is described in further detail. The support structure 9 includes a slider, in the form of collar 17 that is connected to the shaft 3. The collar 17 is able to move along the shaft 3 between the proximal 5 and distal 7 end portions of the shaft 3. The support structure 9 also includes a plurality of arms 19, each arm being disposed about and pivotally connected to the distal end 7 portion of the shaft 3. The support structure 9 also includes a plurality of rods, in the form of spokes 21. The spokes 21 are disposed about and pivotally connected to both the collar 17 and an arm 19.

Movement of the collar 17 along the shaft 3 towards the distal end portion 7 of the shaft 3 causes each spoke 21 to pivot the arm 19 to which it is connected away from the shaft 3 such that the collar 17 is able to re-position, or adjust, the support structure 9 into the erect position. Movement of the collar 17 along the shaft 3 towards the proximal end portion 5 of the shaft 3 causes each spoke 21 to pivot the arm 19 to which it is connected towards the shaft 3 such that the collar 17 is able to re-position, or adjust, the support structure 9 into the collapsed position.

The arms 19 include first 23 and second 25 ends. The first end 23 of the arms 19 is set away (e.g. spaced) from the shaft 3 when the support structure is in the erect position. The second end 25 of the arms 19 is pivotally connected to the distal end portion 25 of the shaft. The arms 19 have a first connector, in the form of mount 27. The mount 27 is mounted intermediate the first 23 and second 25 ends of the arm 19 such that the mount 27 is fixed in position along the arm 19. Referring now to FIG. 5, the arms 19 are described in further detail. The arms 19 include a plurality of second connectors, in the form of connectors 29. As shown in FIG. 4, the connector 29 is mounted intermediate (e.g. between) the mount 27 and the second end 25 of the arms 19 such that the connector 29 is fixed in position along the arm 19.

To inhibit the umbrella from inverting (e.g. folding itself inside out), each leaf spring 13 is resilient and curved along its length in its neutral position. The leaf springs 13 are able to bend when a force is applied to the underside 15 of the canopy 11. The resilience of the leaf springs 13 biases it towards its neutral position, whereby the radius of the curve in the leaf spring is greater than when it is forced into the bent (e.g. compressed) condition. When the support structure 9 is forced towards the inverted position, the first end 23 of each arms 19 bends (e.g. bows along its length) about mount 27. This movement forces the second end 25 of the arm 19 downwards, towards the shaft 3. The leaf spring 13 is compressed between its ends and bent (e.g. the radius of the curve of the leaf spring decreases). The resilience in the leaf spring inhibits the bending of the leaf spring and thereby the movement of the second end 23 of the arm 19 relative to the shaft 3. This inhibits or prevents the inversion process of the umbrella when a force is applied to the underside of the canopy. In alternative embodiments, the leaf spring can be replaced with other biasing means (e.g. an elastically resilient length of rubber, a coil spring).

The leaf springs 13 are also able to self-right the support structure 9 and canopy 11 in the event that the umbrella is inverted (e.g. when the force applied to the underside of the canopy is sufficient to invert the umbrella) The inverted, or inside out position, is shown in FIGS. 11 and 12. In the inverted position, each arm 19 is bent (e.g. bowed, arced) along its length and about the connection (mount 27) between the arm 19 and the spoke 21. This causes the second end 25 of each arm 19 to move towards the shaft 3, thereby compressing the leaf springs 13. The resilience of the leaf spring 13 biases the leaf spring towards its neutral position. In the neutral position the radius of the curve in the leaf spring is greater than when it is compressed (i.e. when the umbrella is forced into the inverted position). The leaf springs 13 tend to straighten upon release of the force applied to the underside 15 of the canopy 11 to thereby self-right the umbrella.

Figure 6:
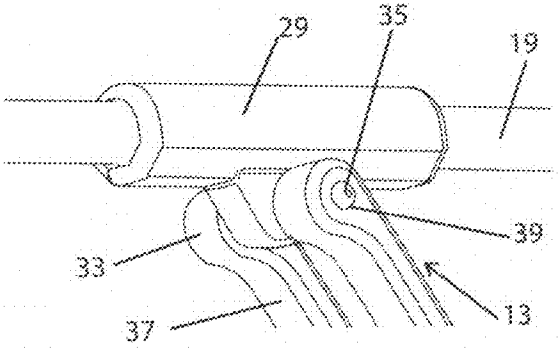
FIG. 6 shows a perspective view of the connection between the leaf spring and the arm.

Referring to FIGS. 4 and 6, the pivotal connections between the spokes 21, arms 19 and leaf springs 13 will be described in detail. Each spoke 21 is pivotally connected to a mount 27. In one form, the mount 27 is moulded to the arm 19, which can be formed from carbon fibre or any other strong material (e.g. fibreglass, metal or polymer). The mounts 27 each comprise an integral projecting finger 31. The projecting fingers 31 have an aperture adapted to receive a pin about which each spoke 21 is able to rotate. Each leaf spring 13 is pivotally connected to the connector 29. Again, the connectors 29 can be moulded to the arms 19 such that they are fixed in position. In alternative embodiments, the connectors 29 and mounts 27 are fixed to the spokes 21 using alternative fixing methods (e.g. they may be glued, clamped, crimped or riveted).

The connectors 29 also comprise a single integral projecting finger 33. The projecting fingers 33 include an aperture adapted to receive a pin 35 about which each leaf spring 13 is able to rotate relative to the connector 29. Each leaf spring 13 is bifurcated 37 at its end adjacent the arm 19. The bifurcated portion 37 of the leaf spring 13 locates on either side of the projecting finger 33 of the connector 29. The bifurcated portion 37 of the leaf spring also includes an aperture 39 that receives the pin 35. The bifurcated portion 37 receives the projecting finger 33 of the connector 29 such that the apertures of the projecting finger 33 and the leaf spring 13 align. In this way, the co-operating apertures are able to receive the pin 35 such that the leaf spring 13 and connector 29 are pivotally mounted to each other. A bifurcation mount is relatively simple, but other forms of pivotal mourning may be employed.

Figure 7:
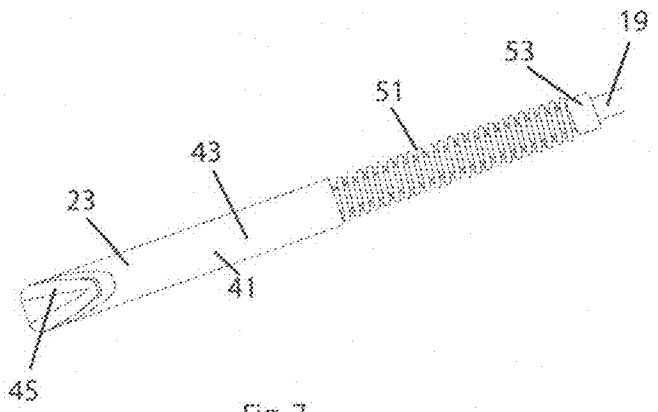
FIG. 7 shows a side view of the canopy tensioner.

The support structure 9 may also include a plurality of canopy tensioners 41. Referring now to FIGS. 4 and 7, the canopy tensioners 41 will be described in detail. The canopy tensioners 41 are connected to the first ends 23 of the arms 19. The canopy tensioners 41 include a body, in the form of tube 43, having an internal cavity that is adapted to receive the arm 19 to which it is connected. The canopy tensioners also include shoulders, in the form of resilient T-bars 45 that are integrally formed with and extend away from the tube 43. The T-bars 45, together with the tube 43, form a T-shaped profile. The outer periphery of the T-bars 45 can be curved to match the somewhat circular profile of the canopy 11. The T-bars 45 are configured to be received by and tension the canopy 11 when the support structure 9 is in the erect position. The T-bars 45 of the canopy tensioners act as load spreaders to spread the radial force acting on the arms 19 about the periphery of the canopy 11 when the support structure 9 is erected. The T-bars also ensure that there are no pointy ends about the periphery of the canopy. Pointy ends can be dangerous, especially when the umbrella is used in crowded areas.

Referring again to FIG. 1, the connection between the canopy tensioners 41 and the canopy 11 is described in further detail. The canopy 11 includes overlapping edges, in the form of compartments 47, about its underside 15 at the periphery 49 of the canopy 11. The canopy tensioners 41 can be located in the compartments 47. The length of each arm 19 is even. In addition, the spacing of the arms 19, and thereby the canopy tensioners 47, about the shaft 3 is even. This ensures that the tension of the canopy 11 is evenly spread throughout the canopy 11. The number of compartments 47 can be the same as the number of arms 19. In an alternate embodiment, the arms 19 may be varied in length to form an asymmetric canopy.

In the detailed form, the compartments 47 are formed from a single length of material that extends about the entire periphery 49 of the canopy 11. This allows for a contrast in colour between the compartments 47 and the canopy 11. This also allows for the compartments 47 to be formed from a different, stronger, material to the canopy 11. In an alternate embodiment, the compartments are formed individually from separate pieces of material.

Referring again to FIG. 7, the canopy tensioners 41 are described in further detail. The canopy tensioners 41 also include a resilient member, in the form of coil spring 51 through which a portion of the arm extends. The spring 51 is disposed about the first end 23 of the arms 19 and fixed to the tube 43. The spring 51 is constrained from movement along the arms 19 by a locator 53 that is mounted to the arms 19. The locator 53 is spaced from the first end 23 of the arm 19. An end of the spring 51 engages the locator 53 and the opposite end engages a wall outside the tube 43. In an alternative embodiment, the spring 51 may engage a wall within the tube 43. In another alternative embodiment, the spring 51 can be a live spring formed from plastic.

Figure 8A:
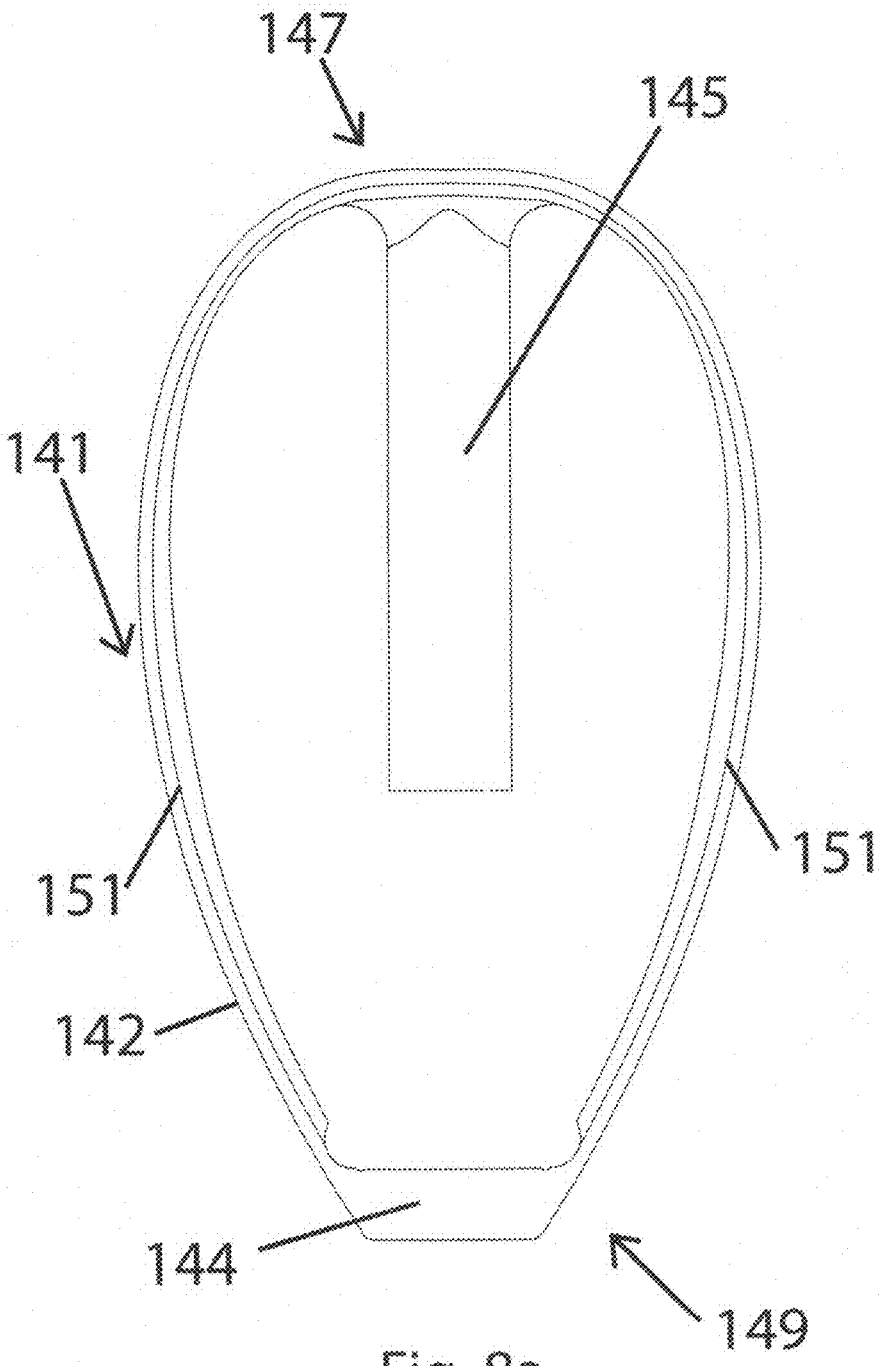
FIG. 8*a-b* show side views of an alternate embodiment of the canopy tensioner in the tensioned (b) and relaxed (a) positions.
Figure 8B:
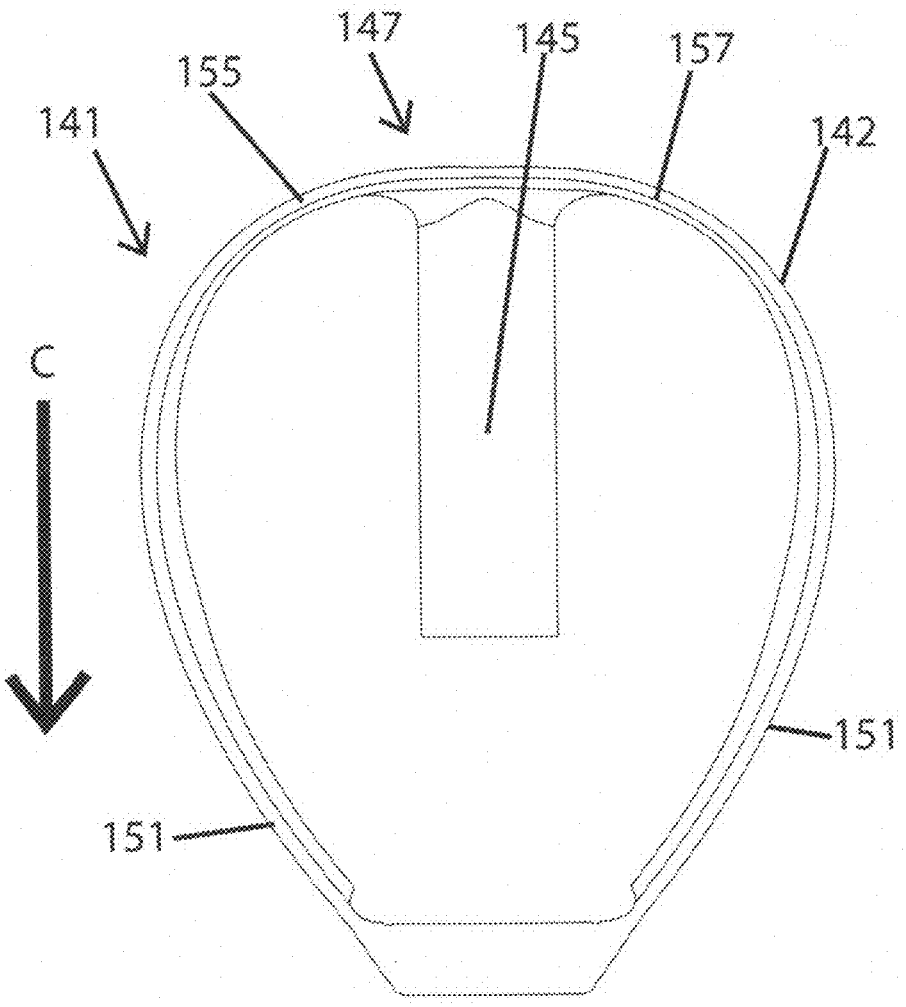

An alternative form of the canopy tensioner is shown in FIG. 8. The canopy tensioner 141 includes opposing resilient members, in the form of opposing leaf springs 151, and an alignment member, in the form of an integrally formed tube 145, through which a portion of the arm of the support structure extends. The tube 145 is able to translate along a respective arm between the tensioned (FIG. 8*b*) and relaxed (FIG. 8*a*) positions. The opposing leaf springs 141 are connected at either end 147, 149 to form a flexible loop 142. The canopy tensioner 141 includes a collar 144 that receives and is fixed to a respective arm. Movement of the tube 141 upon tensioning of the canopy is constrained by the fixed collar 144. Upon tensioning of the canopy, the outer end 147 of the flexible loop 142 engages the canopy pocket and is thereby compressed in the direction represented by arrow C in FIG. 8*a*. This movement causes the opposing leaf springs to flex and the tube 141 to translate (e.g. telescopically slide) along a respective arm of the support structure in the direction of the fixed collar 144. The outer end 147 of the flexible loop 142 is curved to form shoulders 155, 157 that, when in the tensioned position (see FIG. 8*b*), match the somewhat circular profile of the canopy. The flexible loop 142 is configured to be received by and tension the canopy when the umbrella is in the erect position. The shoulders 155, 157 of the flexible loop 142 act as load spreaders to spread the radial force acting on respective arms about the periphery of the canopy when the umbrella is erected. The flexible loops 142 also ensure that there are no pointy ends about the periphery of the canopy, which otherwise may represent a potential for injury (e.g. eye-stick injury).

Figure 15:
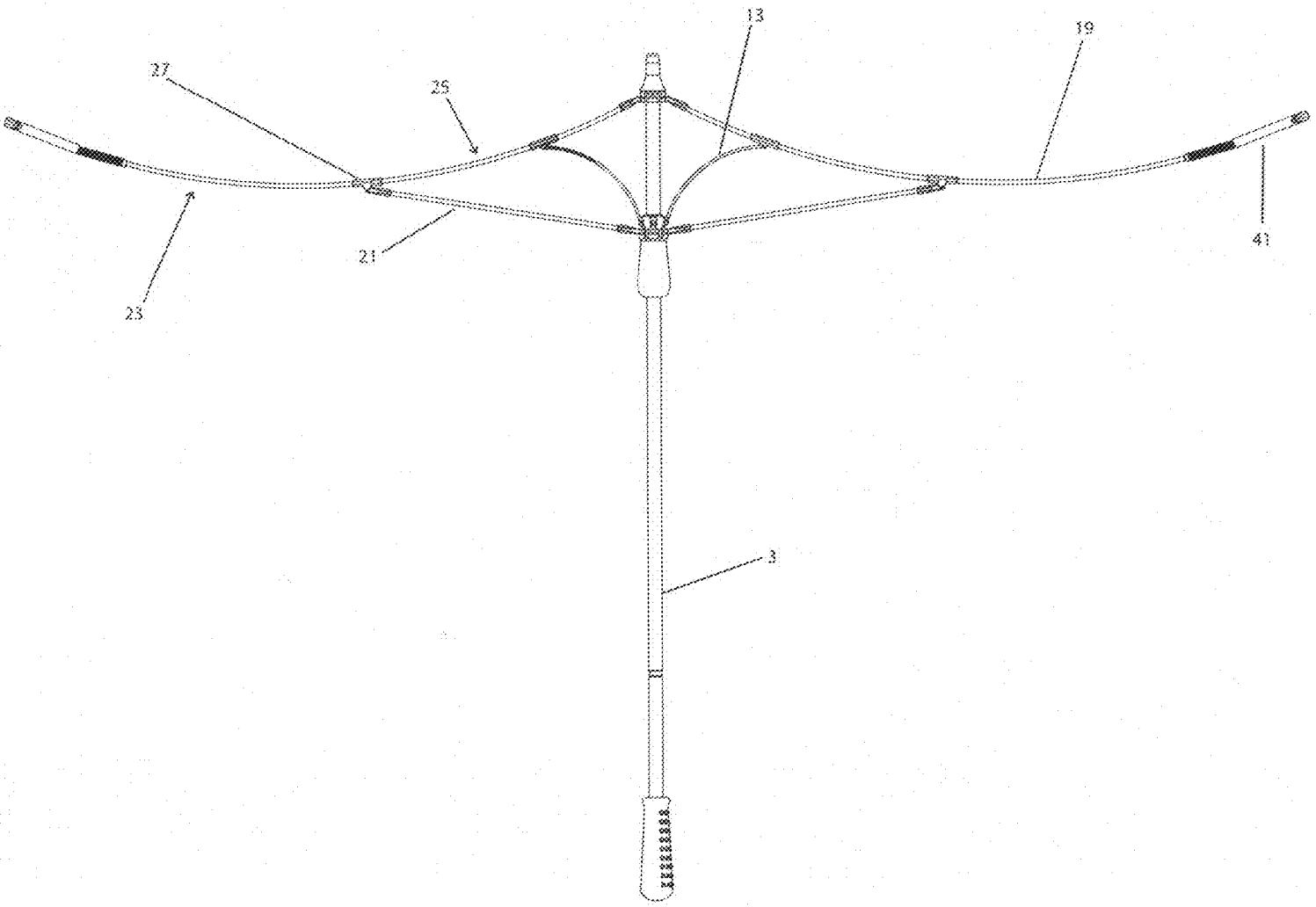
FIG. 15 shows a side view of the umbrella support structure in the inverted position.
Figure 16:
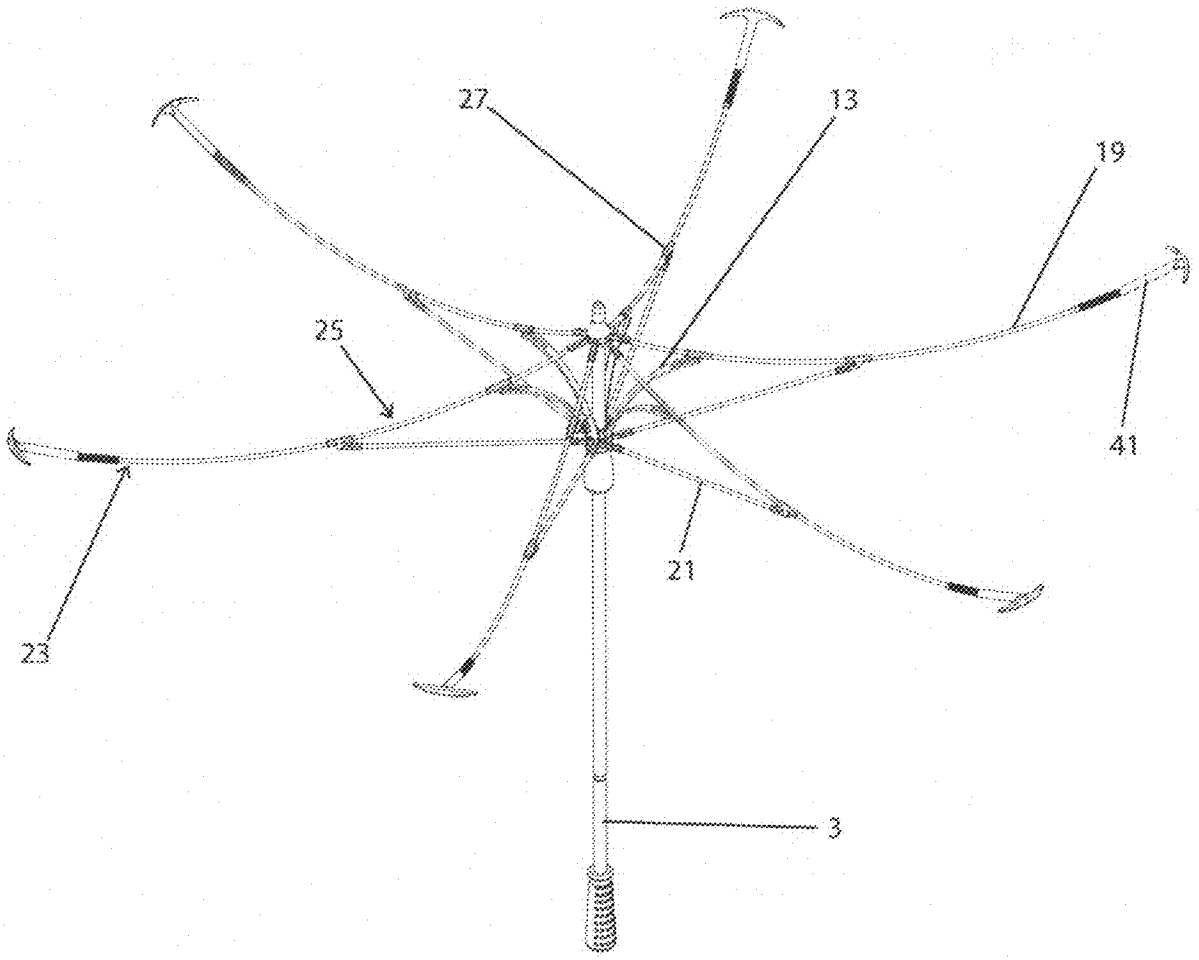
FIG. 16 shows a perspective view of the umbrella support structure in the inverted position.

In the event that the umbrella does invert, as is shown in FIGS. 15 and 16, the canopy tensioners 41 are able to reduce or release the hoop stress in the canopy such that the umbrella can transition relatively easily from the inverted to operating position. For example, when the umbrella transitions to the inverted position, the hoop stress (e.g. tension in the periphery of the canopy) is increased to greater than the operating stress before the umbrella can be returned to its operating position (as shown in FIG. 4). At the point that the arms 19 are substantially perpendicular with the shaft 3, the tension in the canopy is greater than when it is in the operating position. The increased tension in the canopy places an increased stress on the support structure 9 that can damage the support structure 9 and the canopy 11 and make it difficult for the biasing means 13 to return the umbrella to its operating position. The spring 51 allows the tube 43 and T-bar 45 to be displaced laterally along the arm 19, thereby reducing the overall combined length of the arm 19 and canopy tensioner 41 and the tension in the canopy. This assists the umbrella to be self-righting, in that when the leaf springs 13 tend to straighten upon release of the force applied to the underside of the canopy, the canopy tensioners 41 reduce the hoop stress in the canopy as the umbrella transitions from the inverted to erected positions.

Figure 9:
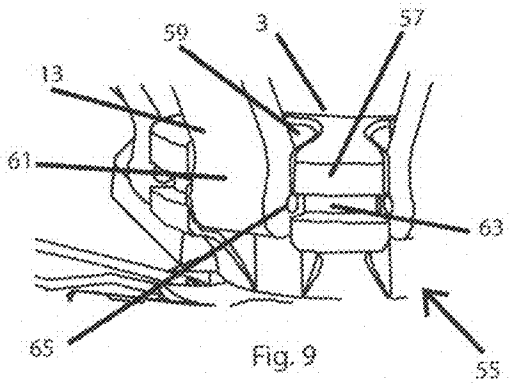
FIG. 9 shows a perspective view of the connection between the shaft and the leaf springs.
Figure 10:
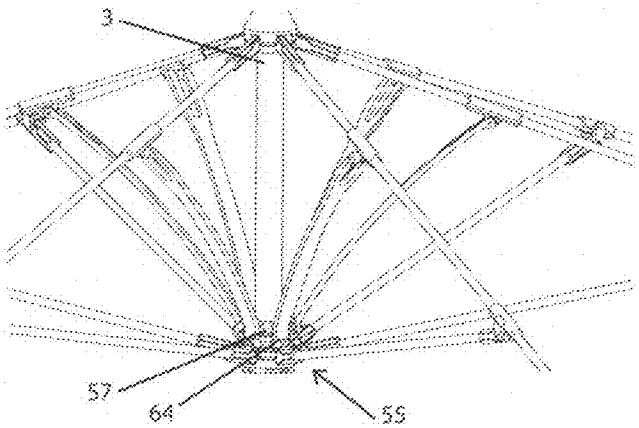
FIG. 10 shows another perspective view of the support structure of the umbrella.

Referring now to FIGS. 9 and 10, the connection between the leaf springs 13 and the shaft 3 will be described in detail. The umbrella includes a collar 55 having an interior channel formed therethrough, the channel configured to receive the shaft 3. A plurality of projections 57 are integrally formed with the collar 55. The projections 57 extend radially about the collar 55, away from the shaft 3 when it is connected. The collar 55 also has a plurality of recesses 59, each recess 59 defined by a space located between a pair of the projections 57. Each recess 59 is configured to receive a base end 64 of a leaf spring 61 such that the leaf springs 61 are able to be pivotally mounted and thereby rotate relative to the collar 55. The collar 55 is slidably mounted to the shaft 3 and, in use, is located intermediate the collar 17 and the pivotal connection between the arms 19 and the shaft 3. The slidable mounting between the collar 55 and the shaft 3 allows for the collar to move up and down the shaft when the support structure 9 of the umbrella is adjusted between its erect and collapsed positions. Each projection 57 includes a groove 63 formed therethrough. The profile of grooves 63 are orientated substantially perpendicular to profile of the recesses 59. The grooves are adapted to receive a retainer, in the form of a length of wire (not shown) that is disposed about the collar 55. Each leaf spring 13 includes an aperture 65 at the base end 64 of the leaf spring. The apertures 65 are aligned to co-operate with the grooves 63 such that they are each able to receive the wire that is threaded through the grooves 63 and the apertures 65 of the leaf springs 13. This connection allows for the leaf springs 13 to be pivotally mounted to the collar 55 such that they can rotate relative to the shaft 3. Alternative encapsulating pivoting mechanisms can be used in lieu of that described above to pivotally connect the shaft 3 and collar 55 to the leaf springs 13.

The umbrella also includes a locking means that is configured to lock the collar 17 to the shaft 3 when the support structure is erected. The locking means can be a conventional locking means used for umbrellas. For example, it can be a detent in the form of a spring-loaded protrusion provided on the shaft 3 that enables the collar 17 to be retained in position such that the umbrella may be locked in its erected position. The locking means can alternatively include a clamp, as will now be described with reference to FIGS. 11*a* and 11*b*. In this embodiment, the shaft 3 includes an indent 57 and clamp 58. The clamp 58 is formed from a flexible body that envelopes the shaft and is operative upon translation of the sliding element 62 along the length of the shaft 3. In use, the sliding element 62 may be gripped by a user and translated up the shaft 3 to adjust the support structure from the collapsed position into the erected position. Upon translation along the shaft 3, the sliding element 62 engages the collar 17 to slide it along the shaft 3. When in the erected position, the clamp 58 engages the indent 57 to prevent the sliding element 62 and the collar 17 from sliding down the shaft 3. The sliding element 62 includes an engaging member 66 that is a resilient body that envelopes the shaft and is formed so as to extend into the interior cavity 69 of the sliding element 62. To lock the locking means, the engaging member 66 engages the head 71 of the clamp 58, thereby forcing the head 71 of the clamp up the shaft 3 and into the indent 57. To unlock the locking means, the engaging member 66 and clamp 58 include co-operating shoulders 73, 75 that engage with each other when the sliding element 62 is translated down the shaft 3, to slide the head 71 of the clamp downwards, along the shaft 3. The engaging member 66 is shorter in length relative to the length of the clamp 58. Thus, when a user slides the sliding element 62 down the shaft, the engaging means will disengage the head 71 of the clamp 58, thereby allowing the clamp to release from the indent. When a user continues to slide the sliding element 62 down the shaft, the shoulders 73 of the engaging member and clamp engages to slide the clamp 58 down the shaft 3 together with the sliding element 62. The shoulders 75 of the clamp also operate in a similar manner to the head 71 of the clamp to lock the umbrella in the collapsed position. A second indent is located at a lower portion of the shaft for this purpose. This locking means provides for a simple to use locking mechanism that does not require two separate actions by the user (e.g. pressing a detent whilst sliding the sliding element). It can also help to eliminate finger injury.

The locking means can alternatively include a locking collar, as will now be described with reference to FIGS. 12 to 14. In this embodiment, the locking means includes a locking collar 77, and an adjustable handle 79 that houses a first inner sleeve 80, a second adjustable outer sleeve 82, and flexible locking tabs, in the form of clips 81. The first sleeve 80 is configured to receive the shaft of the umbrella and, in the detailed embodiment, is integrally formed with the collar 17 to which the spokes of the support structure are connected. In the detailed embodiment, the clips 81 each include a channel 92 configured to receive a portion of live inner lube 80 such the two components are able to translate together along the shaft of the umbrella. The locking means also includes a fixed collar 83. The rubber handle 79 and adjustable sleeve 82 are connected such that adjustment in the position of the handle 79 by a user causes a corresponding adjustment in position of the sleeve 82 relative to the inner sleeve 80. The adjustable sleeve 82 includes rigid exterior teeth 88 that engage the internal rubber wall 90 of the handle 79. As such, translation of the handle 79 towards the canopy (i.e. towards the erect condition) causes a corresponding translation of the adjustable sleeve 82.

Figure 13A:
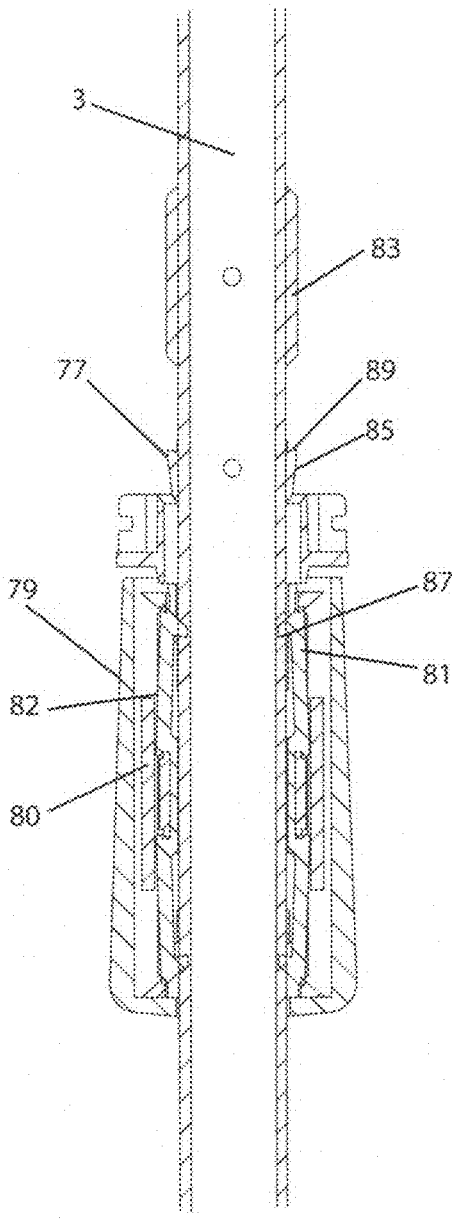
Figure 13C:
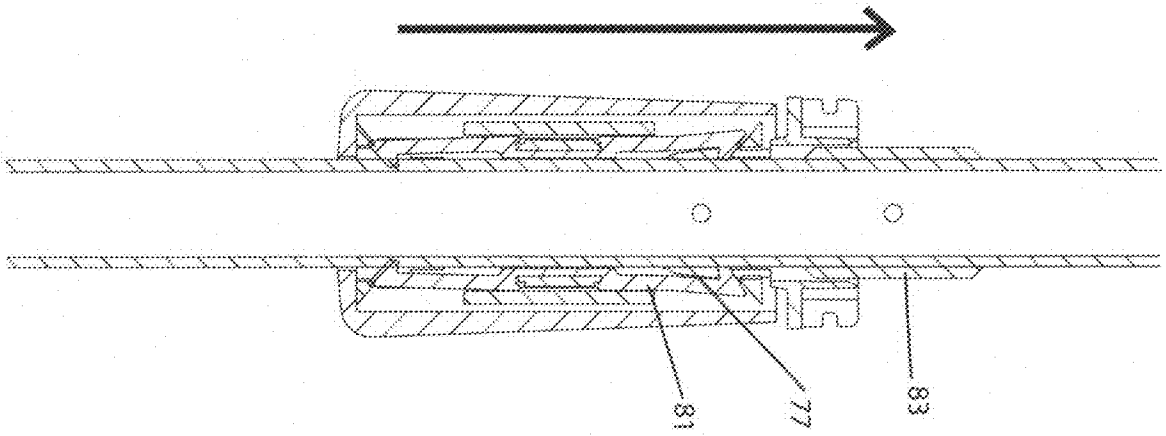
Figure 14:
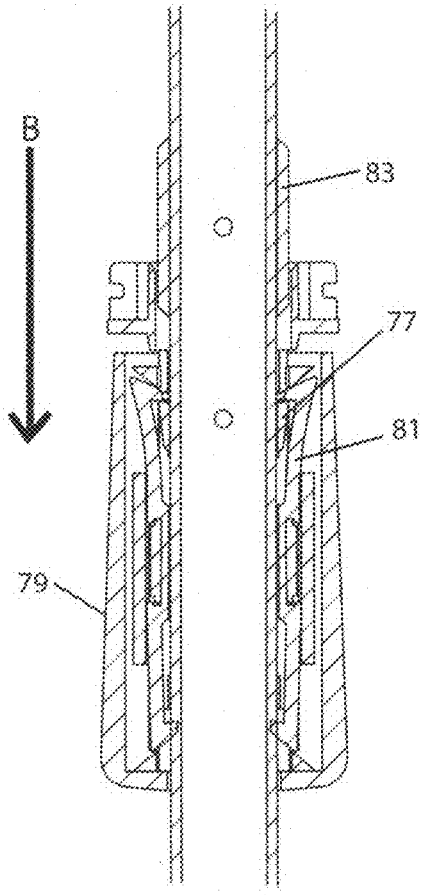
FIG. 14 shows a cross-section through the alternate locking means of FIG. 12 in the unlocked position.

FIGS. 13*a-c* show the interaction of the components of the locking means when the handle 79 is slid by a user in the direction of arrow A from the unlocked (FIG. 13*a-b*) to the locked (FIG. 13*c*) position. When the handle 79 is moved in the direction of arrow A, the sleeve 80 slides over locking collar 77. In addition, the collar 17 that is integrally formed with the inner sleeve 80 slides over the fixed collar 83. The fixed collar 83 provides stability to the locking means and assists to inhibit the sleeve from shaking lose when in the locked position. The locking collar 77 and flexible tabs 81 include cooperating chamfered surfaces 85, 87 such that when the handle 79 is pushed (i.e. slid up the shaft of the umbrella by a user) towards the locked position, the locking collar 77 causes the flexible tabs 81 to flex and slide over the locking collar (see FIG. 13*b*). The locking collar 77 and flexible tabs 81 include cooperating parallel locking surfaces, in the form of an undercut surface 87 of the flexible tab 81 and a ridge 89 of the locking collar 77 arranged such that, when the handle 79 is pushed into locked position, the flexible tabs snap (i.e. flex) into their natural position (i.e. towards the shaft 3) and the interaction between the locking surfaces 87, 89 inhibit movement of the sleeve 80 toward the unlocked position.

To unlock the locking mechanism, the handle 79 is pushed (i.e. slid down the shaft 3) by the user in the direction shown by arrow B in FIG. 13. Internally chamfered walls of the inner sleeve 80 cause the flexible tabs 81 to open (i.e. flex away from shaft of the umbrella) and pass over the locking collar 77 when a user pulls downwardly (i.e. in direction of arrow B) on the handle 79.

In another alternative embodiment, the clamp 58 and engaging member 66 can each be formed from multiple bodies that each extend partially about the periphery of the shaft 3.

In the claims which follow and in the preceding summary except where the context requires otherwise due to express language or necessary implication, the word "comprising" is used in the sense of "including", that is, the features as above may be associated with further features in various embodiments.

Variations and modifications may be made to the parts previously described without departing from the spirit or ambit of the disclosure.

The invention claimed is:

1. An umbrella comprising;

an elongate member having proximal and distal end portions;

a support structure that is connectable to a canopy able to be disposed about the distal end portion of the elongate member, the support structure being adjustable between an erect position, whereby the canopy is able to be tensioned by the support structure, and a collapsed position, whereby the tension in the canopy is able to be released;

a collar having an interior channel formed therethrough, the channel being configured to receive therethrough the elongate member, the collar being slideably mounted to the elongate member to adjust the support structure between the erect position and the collapsed position;

the collar being located adjacent to or on a slider that is also connected to the elongate member, the slider able to move along the elongate member between locations intermediate the proximal and distal end portions of the elongate member to move the collar;

wherein the support structure further comprises:

a plurality of arms, each arm being disposed about and pivotally connected to the distal end portion of the elongate member;

a plurality of rods, each rod being disposed about and pivotally connected to both the slider and a respective arm; wherein movement of the slider along the elongate member towards the distal end portion of the elongate member causes each rod to pivot the arm to which it is connected away from the elongate member such that the slider is able to adjust the support structure into the erect position, and movement of the slider along the elongate member towards the proximal end portion of the elongate member causes each rod to pivot the arm to which it is connected towards the elongate member such that the slider is able to adjust the support structure into the collapsed position; and a plurality of biasing means, each mounted to both the support structure and the collar;

wherein each biasing means is configured to bias the support structure towards, so as to maintain the support structure in, the erect position when a force is applied to an underside of the canopy to inhibit the support structure from inverting, and wherein each biasing means is resilient and curved along its length in a neutral position, corresponding to when the support structure is in the erect position, such that the biasing means is able to bend when the force is applied to the underside of the canopy and the resilience of the biasing means biases it towards the neutral position, and wherein, when the umbrella is in an inverted position, each biasing means tends to straighten upon release of said applied force such that the support structure is biased towards the erect position.

2. The umbrella according to claim 1, wherein each biasing means is pivotally mounted to the support structure.

3. The umbrella according to claim 1, wherein each arm comprises first and second ends, the first end being spaced from the elongate member when the support structure is in the erect position, the second end being pivotally connected to the distal end portion of the elongate member; and wherein each arm comprises;

a first connector, the first connector being mounted intermediate the first and second ends of the arm such that the first connector is fixed in position along the arm; and a second connector, the second connector being mounted intermediate the first connector and the second end of the arm such that the second connector is fixed in position along the arm; and wherein each biasing means is pivotally connected to a respective second connector; and wherein the second connectors are fixed to the arms.

4. The umbrella according to claim 3, wherein each rod is pivotally connected to a respective first connector, and wherein each biasing means is pivotally connected to a respective second connector, and wherein the second connectors are fixed to the arms.

5. The umbrella according to claim 3, wherein the first connectors each comprise a projecting finger, each projecting finger including an aperture adapted to receive a pin about which each rod is able to rotate, and wherein the second connectors each comprise a projecting finger, each projecting finger including an aperture adapted to receive a pin about which each biasing means is able to rotate.

6. The umbrella according to claim 3, wherein the biasing means is interlocking with the projecting finger of the second connector.

7. The umbrella according to claim 3, wherein the support structure further comprises a plurality of canopy tensioners, each canopy tensioner being connected to the first end of a respective arm, wherein each canopy tensioner comprises;

an alignment member having an internal cavity that is adapted to receive the arm to which it is connected; and shoulders that are integrally formed with and extend away from the alignment member, the shoulders configured to be received by and tension the canopy when the support structure is in the erect position.

8. The umbrella according to claim 7, wherein each canopy tensioner further comprises;

opposing resilient members that, in use, are disposed adjacent a respective arm, the resilient members being connected at either end and constrained from movement along the arm by the alignment member and a locator that is mounted to the arm, the locator being spaced from the first end of the arm.

9. The umbrella according to claim 1, further comprising;

a plurality of projections integrally formed with the collar, the projections extending radially about the collar; and a plurality of recesses, each recess defined between adjacent projections;

wherein each recess is configured to receive therein an end of a respective biasing means such that the biasing means is able to be pivotally mounted to the collar.

10. The umbrella according to claim 9, wherein each projection comprises a groove formed therethrough, the grooves being adapted to receive a retainer that is disposed about the collar, and wherein each biasing means comprises an aperture that is able to receive the retainer such that the biasing means can be pivotally mounted to the collar.

11. The umbrella according to claim 1, wherein the biasing means is a sprung member.

* * * * *